US007591612B2

(12) United States Patent
Wong

(10) Patent No.: US 7,591,612 B2
(45) Date of Patent: Sep. 22, 2009

(54) PILING DEVICE

(75) Inventor: Yew Kee Wong, Singapore (SG)

(73) Assignee: YK Equipment Pte Ltd., Singapore (SG)

( * ) Notice: Subject to any disclaimer, the term of this patent is extended or adjusted under 35 U.S.C. 154(b) by 181 days.

(21) Appl. No.: 10/565,985

(22) PCT Filed: Jul. 24, 2003

(86) PCT No.: PCT/SG03/00177

§ 371 (c)(1),
(2), (4) Date: Jan. 24, 2006

(87) PCT Pub. No.: WO2004/042152

PCT Pub. Date: May 21, 2004

(65) Prior Publication Data

US 2006/0216118 A1 Sep. 28, 2006

(51) Int. Cl.
*E02D 13/00* (2006.01)

(52) U.S. Cl. ..... 405/232; 405/229

(58) Field of Classification Search ..... 405/232, 405/231, 229

See application file for complete search history.

(56) References Cited

U.S. PATENT DOCUMENTS 3,827,508 A * 8/1974 MacKinnon ..... 405/232
4,925,345 A 5/1990 McCown, Jr. et al.
5,568,997 A 10/1996 Raunisto
6,368,023 B1 * 4/2002 Lau ..... 405/232

FOREIGN PATENT DOCUMENTS

| | | | |
|---|---|---|---|
| DE | 26 00 173 | A1 | 7/1977 |
| DE | 36 15 596 | A1 | 11/1987 |
| DE | 3815748 | A1 | 11/1989 |
| EP | 0 103 283 | A2 | 3/1984 |
| EP | 0 103 283 | B1 | 7/1988 |
| EP | 0 392 310 | A2 | 10/1990 |
| EP | 0 496 167 | A1 | 7/1992 |
| GB | 747 338 | | 4/1956 |
| GB | 2 161 731 | A | 1/1986 |
| GB | 2 358 035 | A | 7/2001 |
| GB | 2 367 322 | A | 4/2002 |

OTHER PUBLICATIONS

PCT International Search Report dated Sep. 12, 2003, 4 pages.
Supplementary European Search Report dated May 29, 2008, for Application No. EP 03 81 0730 (2 pages).

* cited by examiner

*Primary Examiner*—Frederick L Lagman
(74) *Attorney, Agent, or Firm*—TraskBritt

(57) ABSTRACT

A piling device including a support frame and a footing for mounting the frame. A mechanism for gripping a pile and a mechanism for driving the pile into the ground is provided. Each of the mechanisms can be connected to and supported by the frame, and a pivotal connection can be made. The frame can include an opening for removing the device from around pile while the footing can enable movement of the device.

14 Claims, 3 Drawing Sheets

PILING DEVICE

BACKGROUND OF THE INVENTION

1. Field of the Invention

The present invention relates to the construction and building industries, and more specifically to a device for use in foundation construction. The device has been developed especially, but not exclusively, as a piling device (or piling machine) and the invention is herein described in that context. However, it is to be appreciated that the invention has broader application and is not limited to that particular use.

2. State of the Art

Several forms of piling devices currently exist for driving reinforced concrete and H-beam piles into the ground. These include the hammer piling device. A hammer piling device includes a hammer, which is capable of free falling onto the upper end of a pile in order to drive it into the ground. The pile is mounted in an upstanding steel support frame and is lifted upwardly within the frame via a hydraulic lifting assembly. The hydraulic lifting assembly and frame can be mounted on a truck tray. Such devices are, in relative terms, cost effective to use and mobile. Unfortunately, however, the repetitive impact of the hammer onto the upper end of the pile is extremely noisy. Hammer piling also generates a large amount of ground vibration that is unpleasant, as well as potentially causing damage to buildings and other structures in the vicinity of the piling operation.

Rather than hammering a pile into the ground, a hole can be bored into the ground to the required depth and then the pile can be placed into the hole. Such a procedure requires the use of a downwardly directed rotating bore mounted within a steel frame. A mechanical arrangement for rotating the bore is required. The bore, steel frame and associated mechanical arrangement can be mounted on the tray of a truck, such that it is easily transported.

Advantageously, boring devices tend not to generate the noise or vibrations associated with hammer piling devices. Also boring devices are effective for use in large scale piling operations. Unfortunately, however, the operating cost of boring devices is generally higher than that of hammer piling devices. Also, boring a pile hole as compared to hammer driving an equivalent pile is more time consuming. Another disadvantage of boring is that a temporary area is generally required for placing loose soil for backfilling the pile hole, if necessary. This is inconvenient in many situations.

Alternatively, a hammer piling device can be used in conjunction with a boring device. Both the hammer piling device and the boring device can be mounted on a truck tray. The boring device can be used to prebore a hole. A pile can then be placed into the hole and a hammer piling device can then be used to hammer the pile into the ground to the required depth. Advantageously, preboring the hole has been found to generate less vibration compared with the previously mentioned hammer piling device when used for the entire piling process. Unfortunately, however, preboring a hole adds to the time and cost associated with the piling process. Such arrangements are also of limited piling capacity.

Hydraulic piling devices have been developed in an effort to overcome some of the problems associated with the above-described arrangements. Hydraulic piling devices include an upstanding support frame. One or more hydraulic jacking cylinders are connected at their upper ends to the support frame and extend downwardly within the frame. The lower ends of the hydraulic cylinders include a means for engaging the upper end of the pile. Alternatively, a means is provided at the lower ends of the hydraulic cylinders for gripping around the pile. Extension of the hydraulic cylinders causes the pile to be forced into the ground. The support frame is provided with counterweights to ensure that extension of the hydraulic cylinders causes the pile to be forced into the ground, rather than causing the support frame to lift from the ground. Thus, the pile is driven into the ground not by hammering or boring, but instead by a pushing force. This provides a device that is, in relative terms, substantially free of operating noise, and which generates substantially no vibrations. As a result, these devices are often referred to as "silent piling devices."

Unfortunately, existing silent piling machines include a number of inherent problems and/or limitations.

In instances where the hydraulic jacking cylinders act on the upper end of the pile, the height of the steel support frame must be more than double the pile length for pile installation. These support frames are considerably higher than those of hammer piling machines, and consequently include an inherent instability factor, which must be considered when installing and operating the device. Also, installation of these support frames tends to be, in relative terms, time consuming, labor intensive and, therefore, costly.

Further, once a silent piling machine is installed in place and the counterweights are fitted to the support frame, it is a very time-consuming, labor-intensive and, therefore, costly process to move the device. This potential problem is particularly evident if, during the piling process, the pile encounters a large rock or other object below the surface of the ground, thereby preventing further piling in that particular location. The portion of the pile extending from the ground prevents the device being moved to a new location, leaving the device idle. Indeed, the device remains idle until the pile portion extending from the ground is broken off. Only at this point can the device be moved to a new location.

Finally, such devices are difficult to level on uneven or sloping ground.

It would, therefore, be desirable to address at least some of the above-mentioned problems associated with existing piling and boring devices.

In particular, it would be desirable to provide a pile driving device that can be operated substantially free of hammer impact noise and vibration.

It would also be desirable to provide a device that is cost effective to manufacture and use.

It would be yet further desirable to provide a piling device having a large piling capacity, which is stable, easily maneuverable and relatively simple to level on sloping or uneven terrain.

SUMMARY OF THE INVENTION

According to one aspect of the present invention, there is provided a piling device. The device includes a support frame. The lower end of the support frame is mounted on a footing. A mechanism for gripping a pile and a mechanism for driving the pile into the ground are pivotally connected to and supported by the frame. The pivotal connection of the gripping and driving mechanisms to the frame enables a pile gripped by the gripping mechanism to be aligned in the desired orientation relative to the frame prior to being forced into the ground.

Such an arrangement may enable both the horizontal and vertical adjustment of a pile for installation.

Adjustability of the pivotal connection could be by any suitable means. In one particularly preferred form, pivotal adjustment is undertaken via at least one hydraulically actuated cylinder connected between the frame, and the driving and gripping mechanisms.

It is envisaged that the pivotal connection could be adjustable via a control panel.

According to another aspect of the present invention, there is provided a piling device. The device includes a support frame. The lower end of the support frame is mounted on a footing. A mechanism for gripping a pile and a mechanism for driving the pile into the ground are connected to and supported by the frame. The frame includes at least one opening provided in the side thereof to facilitate removal of the device from around a pile partially extending from the ground.

In one form, the frame includes two openings located on opposite sides of the frame.

The opening(s) is/are sized to allow a pile partially extending from the ground to pass there through in the event that the frame has to be moved during the piling operation.

The at least one opening may be provided with a gate or other suitable closure to prevent access to within the frame during the piling operation. Each gate may be hingedly connected to the frame such that it can be moved between an open position and a closed position.

According to a further aspect of the present invention, there is provided a piling device. The device includes a support frame. The lower end of the support frame is mounted on a footing. A mechanism for gripping a pile and a mechanism for driving the pile into the ground are connected to and supported by the frame. The gripping mechanism is hydraulically operated.

In one form, the gripping force applied by the gripping mechanism to a pile is adjustable such that, within practical limits, a gripping force can be selected to suit a specific requirement.

A control panel may be provided for operating the gripping mechanism, including selection of a desired gripping force.

According to a yet further aspect of the present invention, there is provided a piling device. The device includes a support frame. The lower end of the support frame is mounted on a footing. A mechanism for driving a pile into the ground is provided. The upper end of the pile driving mechanism is connected to the upper end of the frame and extends downwardly relative to the frame. A mechanism for gripping a pile is provided. The gripping mechanism is connected to and extends downwardly from the lower end of the pile driving mechanism.

Connection of the pile gripping mechanism to the lower end of the pile driving mechanism desirably provides the piling device with, in relative terms, a lower centre of gravity. Thus a more stable piling device is achieved.

The driving mechanism and the gripping mechanism may include separate, but connected frames.

According to a still further aspect of the present invention, there is provided a piling device. The device includes a support frame. The lower end of the support frame is mounted on a footing. A mechanism for gripping a pile and a mechanism for driving the pile into the ground are connected to the upper end of the frame and extend downwardly within the frame. The footing includes an arrangement to allow for movement of the piling device. The footing includes ground mounted footings and corresponding frame mounted footings. The frame mounted footings are movably mounted on the respective ground mounted footings.

The frame mounted footings may be movably mounted on the respective ground mounted footings by the inclusion of roller bearing assemblies affixed between the frame and ground mounted footings.

The bearings may be connected to the frame mounted footings and/or ground mounted footings.

Vertically and/or horizontally orientated hydraulic cylinders may be connected to and extend between each pair of frame and ground mounted footings to facilitate movement of the device in the vertical and/or horizontal direction relative to the ground and ground mounted footings.

The ability to move the piling device enables the device to be adjusted and/or moved to a new piling site if and when required.

Each of the hydraulic cylinders may be independently operated via a control panel.

In one form, the piling device includes counterweights mounted on the frame so as to prevent the frame from moving during the piling operation. Specifically, the weights are provided to prevent lifting of the frame during the piling process.

The counterweights may rest on horizontal support surfaces provided on opposite sides of the frame. The counterweights may be releasably secured to the frame.

In a preferred form, the device can be moved with the counterweights mounted on the frame. This is advantageous, because existing silent piling devices require the counterweights to be removed from the frame prior to moving the device. Thus, the present invention provides a considerable time saving when movement of the piling device is necessary.

More than one aspect of the aspect of the present invention has been described above. It is to be appreciated that these aspects can be considered separately or in combination.

It will be convenient to hereinafter describe a preferred embodiment of the invention with reference to the accompanying drawings. The particularity of the drawings is to be understood as not limiting the preceding broad description of the invention.

DETAILED DESCRIPTION OF THE INVENTION

Figure 1:
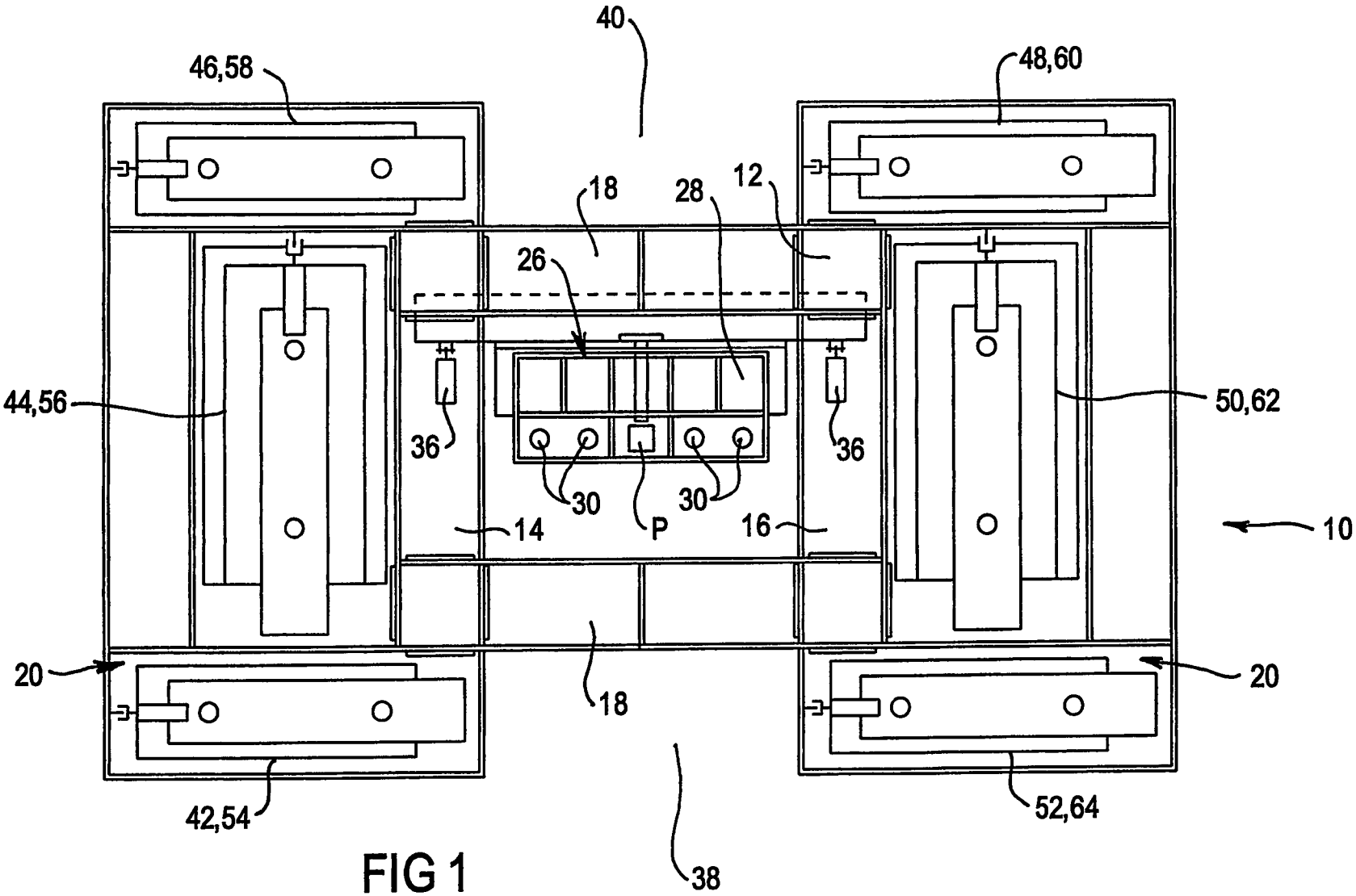
FIG. 1 illustrates in diagrammatic form a plan view of one embodiment of a piling device according to the present invention.
Figure 2:
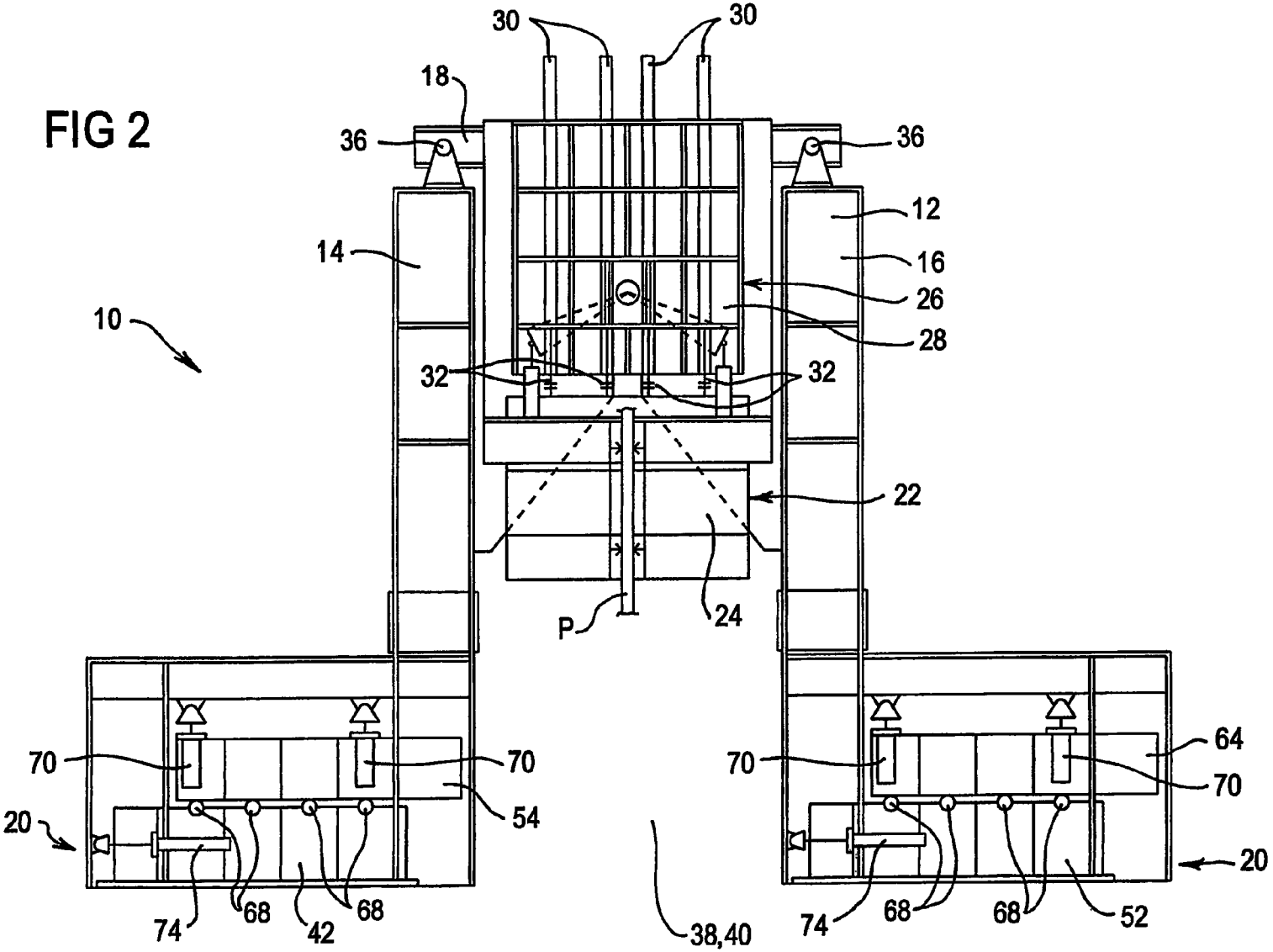
FIG. 2 is a front view of the piling device of FIG. 1.

Referring to the drawings, there is illustrated a device 10 for driving reinforced concrete and H-beam piles into the ground. The device 10 includes a steel support frame 12. The frame 12 includes upstanding beams 14, 16 and cross-beam 18. The lower end of the support frame 12 is mounted on a footing 20, which will be described in greater detail later in the detailed description.

A mechanism 22 for gripping a pile P is provided. The mechanism 22 includes a clamping frame 24. The clamping frame 24 houses powerful hydraulic cylinders (not visible) which are provided to actuate pile engaging clamps (not visible) provided within the mechanism 22. The pile engaging clamps are configured to grip about the circumference of the pile P.

A mechanism 26 for driving the gripping mechanism 22 and pile P in a downward direction relative to the frame 12 is provided. The driving mechanism 26 includes a driving frame 28. The clamping frame 24 is connected to and suspended beneath the driving frame 28 within the frame 12. The driving frame 28 is mounted to cross-beam 18. The driving frame 28 includes four long-stroke hydraulic cylinders 30. Extension of the cylinders 30 causes the lower ends 32 of the cylinders 30 to move downwardly relative to the frame 12 and the driving frame 28. The lower ends 32 of the cylinders 30 are connected to the clamping frame 24, such that extension of the cylinders 30 causes the clamping frame 24 to move downwardly relative to the frame 12 to force the pile P into the ground.

The driving frame 28 is pivotally connected to beam 16 at pivots 34. The clamping mechanism 22 and driving mechanism 26 can be angularly adjusted relative to the frame 12 about pivot 34 by hydraulic adjusting cylinders 36. Cylinder 36 is connected between the frame 12 and the driving frame 28. This enables the pile P to be adjusted to the desired angle relative to the frame 12 prior to driving into the ground.

Providing a separate gripping mechanism 22 mounted below the driving mechanism 26 lowers the center of gravity of the overall piling device 10. This provides a more stable device 10 when compared to many existing piling devices.

Openings 38, 40 are provided on opposite sides of the frame 12. The openings 38, 40 are advantageously of a size sufficient to enable the frame 12 to be moved away from a pile partially extending from the ground, should the piling process encounter difficulties (such as the pile P encountering impenetrable rock).

Figure 3:
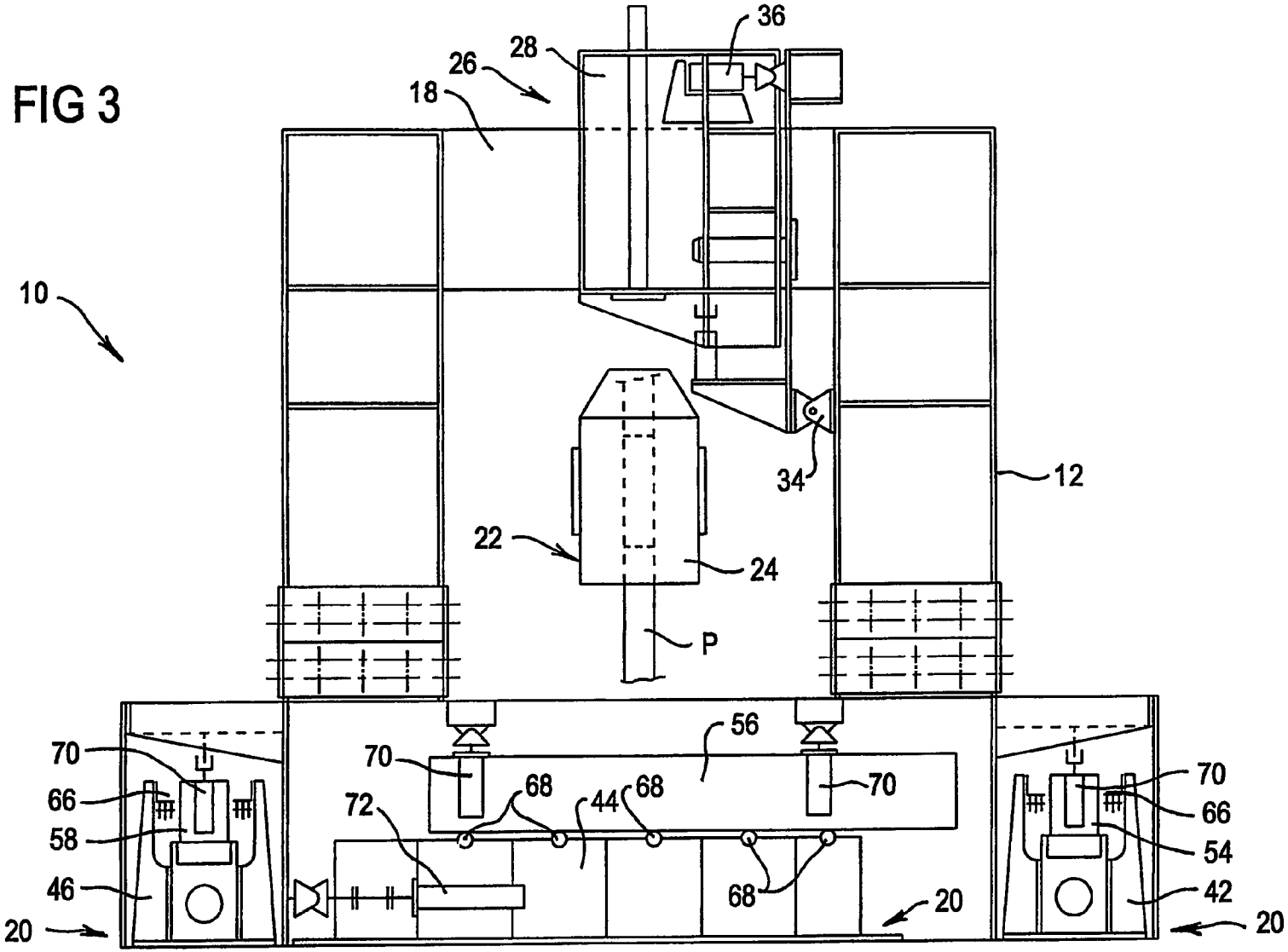
FIG. 3 is a side view of the piling device of FIG. 1.

The footing 20 includes six ground mounted footings 42, 44, 46, 48, 50, 52 and six corresponding frame mounted footings 54, 56, 58, 60, 62, 64. Each of the ground mounted footings 42, 44, 46, 48, 50, 52 includes a channel 66 (most clearly illustrated in FIG. 3). Each channel 66 accommodates a frame mounted footing. Each pair of ground mounted footings 42, 44, 46, 48, 50, 52 and frame mounted footings 54, 56, 58, 60, 62, 64 are separated by roller bearings 68.

Vertically extending hydraulic cylinders 70 are connected between the frame 12 and the frame mounted footings 54, 56, 58, 60, 62, 64. The hydraulic cylinders 70 are provided for raising and lowering the device 10.

Horizontally extending hydraulic cylinders 72, 74 are connected between the frame 12 and the ground mounted footings 42, 44, 46, 48, 50, 52. The cylinders 72 are provided for moving the device 10 in the forward and reverse directions. Cylinders 74 are provided for moving the device 10 in the sideways directions.

Each of the various hydraulic cylinders provided in the device 10 are operable via a control panel (not illustrated).

Finally, it is to be understood that various alterations, modifications and/or additions may be introduced into the construction and arrangement of the parts previously described without departing from the spirit or ambit of this invention.

The invention claimed is:

1. A piling device, including:

a support frame having a lower end mounted on a footing;

a mechanism for gripping a pile;

a mechanism for driving the pile into the ground;

the gripping mechanism and the pile driving mechanism being pivotally connected to and supported by the support frame;

the pivotal connection of the gripping and pile driving mechanisms to the support frame enabling a pile gripped by the gripping mechanism to be aligned in the desired orientation relative to the support frame prior to being driven into the ground.

2. A device according to claim 1, wherein the pivotal connection enables angular adjustment of a pile gripped by the gripping mechanism relative to the support frame.

3. A device according to claim 1, wherein a pivotal adjustment actuator is provided, the pivotal adjustment actuator including at least one hydraulically actuated cylinder connected between the support frame, and the pile driving and/or gripping mechanisms.

4. A piling device, including:

a support frame having a lower end mounted on a footing;

a mechanism for gripping a pile;

a mechanism for driving the pile into the ground;

the gripping mechanism and the pile driving mechanism being connected to and supported by the support frame; wherein the support frame includes at least one opening provided in a side thereof to facilitate removal of the device from around a pile partially extending from the ground.

5. A device according to claim 4, wherein the opening is sized to allow a pile partially extending from the ground to pass there through in the event that the support frame has to be moved during the piling operation.

6. A device according to claim 4, wherein the device includes two openings located on opposite sides of the support frame.

7. A piling device, including:

a support frame having a lower end mounted on a footing;

a mechanism for gripping a pile;

a mechanism for driving the pile into the ground;

the gripping mechanism and the pile driving mechanism being connected to and supported by the support frame; wherein the gripping mechanism is hydraulically operated;

the gripping force applied by the gripping mechanism to the pile is adjustable; and a control panel is provided for operating the gripping mechanism, including selection of a desired gripping force.

8. A piling device, including:

a support frame having a lower end mounted on a footing;

a mechanism for driving a pile into the ground;

an upper end of the pile driving mechanism is connected to the upper end of the support frame and extends downwardly relative to the support frame;

a mechanism for gripping a pile; wherein the gripping mechanism is connected to and extends downwardly from the lower end of the pile driving mechanism; and the pile driving mechanism includes a driving frame and hydraulic cylinders extendable downwardly relative to the driving frame, wherein the lower end of the hydraulic cylinders are connected to the gripping mechanism.

9. A piling device, including:

a support frame having a lower end mounted on a footing;

a mechanism for gripping a pile;

a mechanism for driving the pile into the ground;

the gripping mechanism and the pile driving mechanism being connected to and supported by the support frame;

the footing including ground mounted footings and respective frame mounted footings;

the frame mounted footings being movably mounted on the respective ground mounted footings; and vertically orientated hydraulic cylinders connected to and extending between each pair of frame and ground mounted footings to facilitate movement of the device in the vertical direction relative to the ground and ground mounted footings.

10. A device according to claim 9, wherein the frame mounted footings are movably mounted on the respective ground mounted footings by the inclusion of roller bearing assemblies between the frame mounted footings and ground mounted footings.

11. A device according to claim 10, wherein the bearings are connected to the frame mounted footings and/or ground mounted footings.

12. A device according to claim 9, wherein horizontally orientated hydraulic cylinders are connected to and extend between each pair of frame and ground mounted footings, to facilitate movement of the device in a horizontal direction relative to the ground and ground mounted footings.

13. A device according to claim 9, including counterweights mounted on the support frame to prevent the frame from moving during the piling operation.

14. A device according to claim 13, wherein the device can be moved with the counterweights mounted on the support frame.

* * * * *